United States Patent [19]

Oda et al.

[11] 4,222,771

[45] Sep. 16, 1980

[54] HIGH CHROMIUM STEEL OF MIXED STRUCTURE CONTAINING FERRITE FOR HIGH TEMPERATURE USE

[75] Inventors: Teishiro Oda, Nagasaki; Takashi Daikoku, Togitsumachi; Teruo Yukitoshi, Fujiidera; Kazuhiko Nishida, Kobe, all of Japan

[73] Assignees: Mitsubishi Jukogyo Kabushiki Kaisha, Tokyo; Sumitomo Metal Industries Limited, Osaka, both of Japan

[21] Appl. No.: 5,762

[22] Filed: Jan. 23, 1979

Related U.S. Application Data

[63] Continuation of Ser. No. 788,467, Apr. 18, 1977, abandoned, which is a continuation of Ser. No. 661,330, Feb. 25, 1976, abandoned, which is a continuation-in-part of Ser. No. 600,428, Jul. 30, 1975, abandoned, which is a continuation-in-part of Ser. No. 430,532, Jan. 3, 1974, abandoned.

[30] Foreign Application Priority Data

Feb. 28, 1973 [JP] Japan ..... 48-23841

[51] Int. Cl.[2] ..... C22C 39/02

[52] U.S. Cl. ..... 75/124; 75/126 B; 75/126 C; 148/37

[58] Field of Search ..... 75/126 B, 126 C, 126 D, 75/126 P, 124, 126; 148/36, 37, 38

[56] References Cited

U.S. PATENT DOCUMENTS

| | | | |
|---|---|---|---|
| 2,123,144 | 7/1938 | Newell | 75/126 C |
| 2,835,571 | 5/1958 | Smith | 75/126 C |
| 2,905,577 | 9/1959 | Harris et al. | 148/31 |
| 3,539,338 | 11/1970 | Mimino et al. | 75/126 C |
| 3,834,897 | 9/1974 | Nevalainen | 75/124 |
| 3,847,600 | 11/1974 | Mimino et al. | 75/126 P |
| 3,926,685 | 12/1975 | Gueussier et al. | 148/37 |

FOREIGN PATENT DOCUMENTS

| | | | |
|---|---|---|---|
| 45-41501 | 12/1970 | Japan | 75/126 C |

OTHER PUBLICATIONS

Metals Handbook, 8th Ed., vol. 1, p. 436, 1961.

*Primary Examiner*—M. J. Andrews
*Attorney, Agent, or Firm*—Toren, McGeady and Stanger

[57] ABSTRACT

High chromium steel, for use at high temperature, of a mixed structure containing ferrite and 0.02–0.09% C, less than 1.0% Si, 0.1–2.0% Mn, 7.0–13.0% chromium, 1.2–3.0% Mo, and the rest being iron and the usual impurities, or further adding aluminum in an amount less than 0.1% to said composition, or further adding 0.001–0.1% boron and less than 0.1% Ti necessary to cause the boron to act effectively, said steel being heated at temperatures lower than about 1050° C. to prevent the oxidation of the steel.

2 Claims, 2 Drawing Figures

HIGH CHROMIUM STEEL OF MIXED STRUCTURE CONTAINING FERRITE FOR HIGH TEMPERATURE USE

CROSS-REFERENCE TO RELATED APPLICATIONS

This application is a continuation of application Ser. No. 788,467, filed on Apr. 18, 1977, now abandoned which, in turn, was a continuation of application Ser. No. 661,330, filed on Feb. 25, 1976, now abandoned, which, in turn was a continuation-in-part of application Ser. No. 600,428, filed on July 30, 1975, now abandoned, which, in turn, was a continuation-in-part of application Ser. No. 430,532, filed on Jan. 3, 1974, now abandoned.

BACKGROUND OF THE INVENTION

1. Field of the Invention

The present invention relates to high chromium steel for use as a high temperature material, consisting of a mixed structure containing ferrite and which possesses excellent oxidation resistance and high temperature strength, good weldability and toughness, and is thus suited for use as heat exchanger material in chemical industry equipment and machinery.

2. Description of the Prior Art

Materials that serve to transmit heat inside and outside the pipe as the super heater piping and reheater piping of the boiler, the heating piping and heat exchanger piping of equipment and apparatus for the chemical industry require sufficient oxidation resistance and high temperature strength to satisfy the conditions under which they are used as well as good weldability since almost all of them are assembled by welding. Also desirable is an economical cost.

As an example, the steel presently used in the superheater pipe and reheater pipe of a power plant boiler is 2¼Cr-1 Mo steel for pipe wall temperatures up to 590° C., 9 Cr-1 Mo steel or 18 Cr-8 Ni stainless steels for temperatures up to 650° C., and 18 Cr-8 Ni stainless steel for temperatures above 650° C.; the higher the service temperature, the better the quality of the material used. With 2¼Cr-1 Mo steel, there is no difficulty with respect to the oxidation resistance and high temperature strength under the normal working conditions as well as in the toughness and economical requirements. In the case of 9 Cr-1 Mo steel, the oxidation resistance is sufficient when the pipe wall temperature is below 650° C., and there is no problem with the toughness. However, the disadvantage is that the high temperature strength is insufficent and the scope of application may be limited depending on the working stress. The most serious defect of this steel is its poor weldability, and it is often liable to incur welding cracks. 18 Cr-8 Ni stainless steels retain sufficient oxidation resistance and high temperature strength even when used at 650° C. or higher temperatures and are in extensive use and applications. They are, however, unfavorable in that the material cost is higher because of high nickel content than in case of a 9 Cr-1 Mo steel.

A grade of high chromium steel having a single ferrite phase has been proposed for the purpose of eliminating the aforesaid defects encountered in conventionally used steels. A sufficiently high strength at high temperatures may be provided by properly adjusting the strengthening elements and there is little possibility of hardening because of its single ferritic phase; consequently, there is no problem with the weldability. One problem of this steel, however, is that the toughness is not satisfactory. In other words, its impact fracture transition temperature is fairly high. For this reason, it is inevitable that the application of this steel is restricted. Also proposed is a high chromium steel of a two-phase structure with the object of eliminating the above-mentioned defects of the single ferrite phase steel. However, with this steel, a ferrite forming element, such as, titanium and aluminum, is added to obtain a two-phase structure and a carbide forming element, such as, vanadium and niobium is also added to secure high temperature strength. However, special consideration must be paid to the prevention of the oxidation loss and other factors for adjusting the composition since highly oxidizing titanium and aluminum are present, which can also present problems from an economical viewpoint.

SUMMARY OF THE INVENTION

The present invention is proposed in view of the aforesaid situation. The object of this invention is to provide, as a material for use at 650° C. or higher temperatures, an economical high chromium steel possessing oxidation resistance equal to or higher than that of the presently used 9 Cr-1 Mo steel, very high strength at elevated temperatures, and sufficient weldability and toughness for the end uses noted above.

The high chromium steel of the present invention contains 0.02–0.09% carbon, less than 1.0% silicon, 0.1–2.0% manganese, 7.0–13.0% chromium, and 1.2–3.0% molybdenum, the rest being iron and usual impurities, or under 0.1% aluminum added to the above composition, or 0.001–0.1% boron and under 0.1% titanium which is added to improve the effectiveness of the boron. The high chromium steel thus obtained consists of a mixed structure of ferrite and bainite phases. Since this steel possesses low hardenability, it exhibits by far better weldability than the conventionally used 9 Cr-1 Mo steel which forms the perfectly martensitic or bainitic structure in the welding heat-affected zone.

The steel is formed into ingots which are forged and rolled into plates and the like in the conventional manner except that the steel, after forging, etc., is not heated higher than about 1050° C.

DESCRIPTION OF THE PREFERRED EMBODIMENTS

Figure 1:
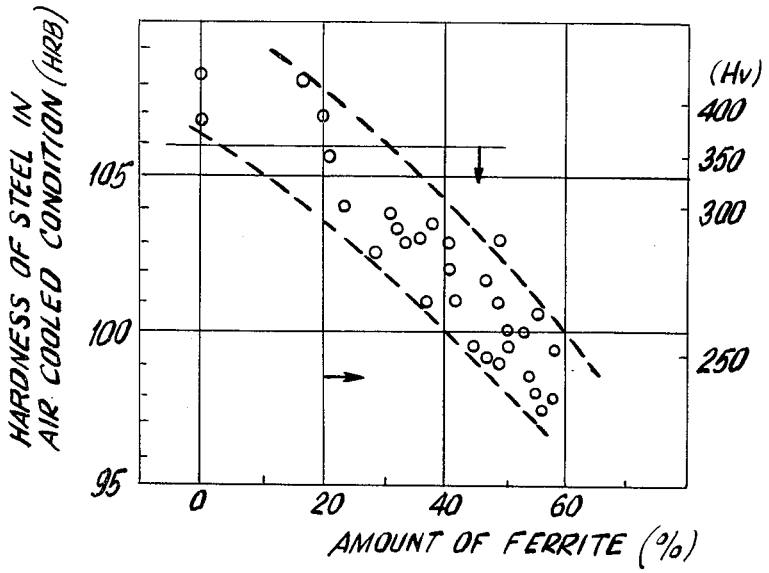
FIG. 1 is a graph showing the relationship of the hardness of steel and the amount of ferrite.

Hereinbelow, the effect of each alloy composition of the steel of this invention and reasons for limiting the range of such composition will be presented.

Carbon combines with carbide-forming elements to precipitate carbides and thereby increases the creep strength, and produces an important element for forming a mixed structure containing ferrite. It is not economical, however, to have a steel containing less than 0.02% carbon due to processing conditions used in making the steels. If the carbon content exceeds 0.09%, difficulty arises in obtaining a mixed structure and the weldability is deteriorated. Hence, the carbon is limited to the range of 0.02–0.09%.

Chromium is an element that increases the oxidation resistance and high temperature strength. More than 7% is required to give the steel sufficient oxidation resistance, but if it is added in excessively large amounts, the weldability is degraded and embrittlement occurs when the steel is used at high temperatures. For these reasons, the chromium content is restricted within the limits of 7.0–13.0%.

Molybdenum dissolves into a ferrite matrix in the form of a solid solution and strengthens the matrix and, in addition, elevates the creep strength by forming molybdenum carbide. It is an important element in the steel of this invention for forming a mixed structure in correlation to the amount of chromium. When the molybdenum content is less than 1.2%, the formation of a mixed structure is prevented; and when such addition exceeds 3.0%, the toughness is deteriorated and the steel is not economical. The range of addition of molybdenum is accordingly established as from 1.2 to 3.0%.

The steel according to this invention exhibits excellent high temperature strength even when boron is not present. However, if boron is added, the rupture strength is increased due to its presence on the long time side. The effects of boron appear on addition of as little as 0.001%, but tend to subside when it exceeds 0.1%. Therefore, the addition of boron is limited to 0.0001–0.1% in those rases when it is to be specifically added.

Silicon acts as a deoxidizer and therefore is a useful element for obtaining a proper structure. However, if silicon is added in large amounts, the toughness is reduced and the weldability is detrimentally affected. Accordingly, the silicon content should be less than 1%.

Manganese improves the workability of steel at high temperatures and is a useful element to obtain a proper structure. However, if the content is lower than 0.1%, it does not provide a marked effect, and when it is added in too large amounts, it tends to cause a brittle and hard phase, which is undesirable. The preferred range of manganese is from 0.1 to 0.2%.

A two-phase structure may be obtained even if aluminum is not added, but the ferrite is further stabilized by the addition of aluminum. If aluminum is added in large amounts, the amount contained in the steel results in increasing the total amount of the composition. Thus, the aluminum contept is limited to 0.1%.

Titanium is an effective deoxidizer as well as an element necessary for boron to act effectively. However, the main purpose of the presence of Ti in the present composition is to improve the effectiveness of the boron, which is to remove the acids and the nitrogen. If, however, Ti were added in amounts larger than 0.1%, the constituents in the steel would increase which would lead to a deterioration in the ductility.

Titanium is also a strong ferrite former and when the amount of Ti is maintained at no more than 0.1%, most, if not all, of the Ti reacts to become an oxide or a nitride. Consequently, there is little or no Ti present to effect the ferrite formation.

If any significant amount of Ti is present to exert an effect on the ferrite formation, the increase in ferrite formation resulting therefrom produces deterioration of the high temperature strength and toughness. Consequently, the upper limit of the titanium content is set at 0.1%.

The smaller the content of phosphorus and sulfur, the better. It is desirable to control the content of phosphorus and sulfur below 0.035% in which case no unfavorable effects are usually observed. The steel should not contain any significant amount of Nb. In order for a solid solution of Nb and the carbon to form, with the nitrogen, a compound which would provide some high temperature strength, it is necessary for the steel to be heated to at least above 1050° C. However, at such temperatures, scaling due to oxidation occurs on the surface of the steel and the surface becomes roughened.

Moreover, the presence of Nb markedly increases the tendency for the formation of weld cracks due to the formation of an Fe-Nb eutectic material. Additionally, Nb is a strong ferrite former and with Nb present, it becomes much more difficult to control the ferrite formation in a mixed structure containing ferrite.

It is also noted, that it is important that the composition not be heated at a temperature above 1050° C. Otherwise difficulties with respect to the surface oxidation and scaling will result. Thus, one cannot obtain the high temperature strength and avoid the scaling problem.

As indicated hereinabove, the steel composition of the present invention is composed of a mixed structure of ferrite and bainite phases, rather than a single bainite phase. The amount of ferrite phase should be sufficient to provide the required hardening characteristics. However, if too much of the is present, the improved hardening properties are outweighed by the decreased strength and toughness. Preferably, the amount of ferrite is in the range from about 20% to 60% by weight. If the amount of the ferrite is below this range, the hardness of the steel is inadequate. Thus, as shown in FIG. 1, the hardness of the steel (in the air cooled condition) should be less than about 106 HRB which requires a ferrite concentration of more than about 20%.

Figure 2:
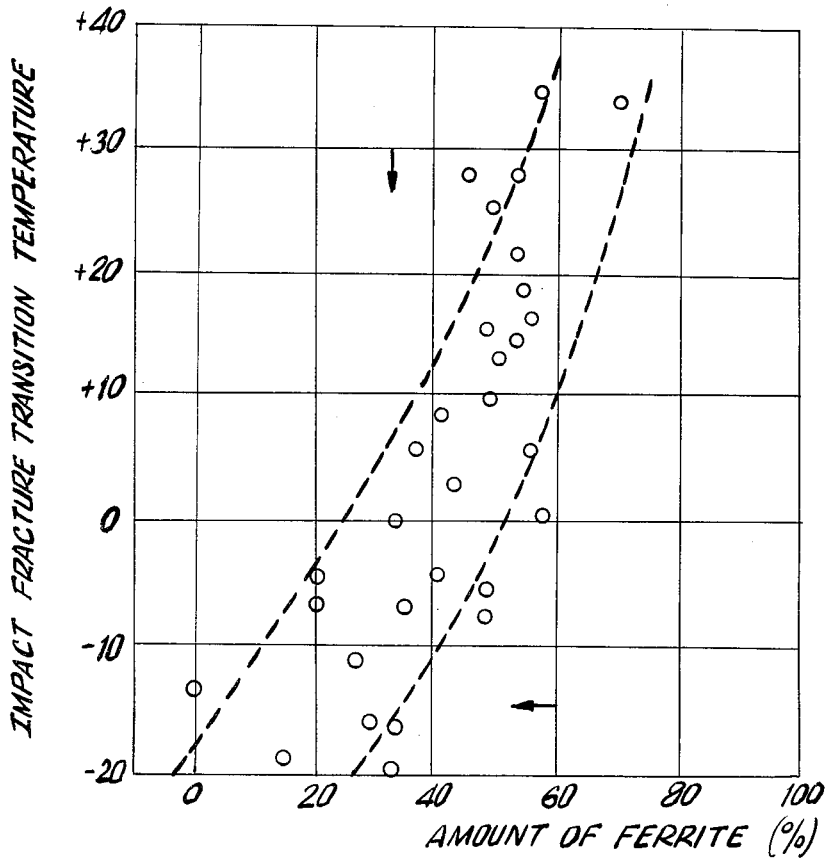
FIG. 2 is a graph showing the relationship between the impact fracture transition temperature and the ferrite content.

However, in order to provide the proper strength and low temperature toughness requirements for the steel composition, as shown in FIG. 2, the impact fracture transition temperture should be less than about 30° C., which requires an upper ferrite concentration of no more than about 60% by weight.

The following examples illustrate the invention.

Table 1 shows the chemical compositions of steels which were subjected to tests. Ingots having such compositions are forged and rolled, formed into 15 mm thick steel plates, normalized at 1050° C., and undergo tempering treatment at 700° C.

Table 2 shows the summarized results of creep rupture tests at test temperature of 600° C. on the steels of this invention and the materials tested for comparison. It is seen from these results the creep rupture strength according to the present invention is by far higher than that of conventionally used 9 Cr-1 Mo steel tested for comparison. Amoung all tested steels, the creep rupture strength of specimens C-G and I-K steels is especially excellent.

Creep rupture strength at 650° C. of the steels of this invention is lower in all cases than those conducted at 600° C. in stress in equal rupture time. However, the tendency is the same as in the case at 600° C. The superiority of the steel of the present invention to the presently used 9 Cr-1 Mo steel is confirmed.

Weldability is tested as follows. On the surface of 15 mm thick steel plates, one layer of build-up welding is conducted using a 18 Cr-8 Ni stainless steel welding rod, and the hardness of the base metal and the maximum hardness of the welding heat-affected zone are measured and compared. The results are shown in Table 3 summarized in the left half part. The weldability of steel is, in general, lowered as the welding heat-affected zone hardens, but in case the Vickers hardness is below 300, there is no difficulty in practical application. While the welding heat-affected zone of conventionally used 9 Cr-1Mo steel tested for comparison hardens about 2.5 times as much as the base metal, the hardening of the welding heat-affected zone of this steel is not as much, since the steel of this invention is formed from a mixed structure containing ferrite by adjusting the composition. Consequently, the weldability of the steel of the present invention is excellent.

Toughness is determined by Charpy V-notch impact testing, and the fracture transition temperatures are found for comparison with each other. The right half part of Table 3 shows the summarized results. Comparison is made here also with a steel of a single ferrite phase in addition to 9 Cr-1 Mo steel. As evident from the table, the transition temperature of the steel of a single ferrite phase is the highest. In contrast to that, the steels of the present invention each possess a transition temperature lower than that of 9 Cr-1 Mo steel and exhibit excellent toughness. As compared with the steel with a single ferrite phase, the toughness of this steel is far better and does not cause any difficulties in practical application.

As described thus far, the steel according to the present invention possesses high temperature strength superior to the presently used Cr-Mo steel, excellent toughness, good weldability, and sufficient high temperature strength in the temperature range of from 600° to 650° C. Therefore, the present steel may be used as a substitute for expensive 18 Cr-8 Ni austenitic stainless steel and the steel of this invention is very advantageous as an economical material for heat exchangers.

TABLE 1

| | | C | Si | Mn | P | S | Cr | Mo | Ti | Al | B |
|---|---|---|---|---|---|---|---|---|---|---|---|
| Steels of this invention | A | 0.025 | 0.32 | 0.02 | 0.015 | 0.015 | 8.99 | 2.03 | — | 0.08 | — |
| | B | 0.040 | 0.31 | 0.52 | 0.014 | 0.013 | 8.97 | 2.01 | — | — | — |
| | C | 0.076 | 0.26 | 0.49 | 0.015 | 0.015 | 9.10 | 2.87 | — | 0.02 | — |
| | D | 0.059 | 0.06 | 0.52 | 0.011 | 0.012 | 9.65 | 1.98 | — | 0.04 | — |
| | E | 0.045 | 0.71 | 0.50 | 0.011 | 0.013 | 8.90 | 2.03 | — | — | — |
| | F | 0.030 | 0.35 | 1.80 | 0.015 | 0.018 | 9.10 | 2.00 | — | — | — |
| | G | 0.062 | 0.25 | 0.54 | 0.019 | 0.012 | 7.55 | 1.98 | — | — | — |
| | H | 0.051 | 0.21 | 0.48 | 0.019 | 0.014 | 12.36 | 1.82 | — | — | — |
| | I | 0.055 | 0.36 | 0.85 | 0.018 | 0.012 | 8.81 | 2.80 | — | 0.01 | — |
| | J | 0.060 | 0.30 | 0.54 | 0.011 | 0.014 | 9.18 | 2.12 | 0.02 | 0.03 | 0.003 |
| | K | 0.080 | 0.26 | 0.5 | 0.011 | 0.012 | 9.01 | 2.08 | 0.08 | 0.04 | 0.090 |
| Compared materials | 9 Cr - 1 Mo steel | 0.11 | 0.64 | 0.45 | 0.021 | 0.006 | 8.65 | 0.97 | — | — | — |
| | Steel of single ferrite phase | 0.06 | 0.31 | 0.58 | 0.012 | 0.014 | 8.84 | 1.99 | 1.09 | 0.12 | 0.022 |

TABLE 2

| | Test specimen | Creep rupture time (hr) (600° C. stress 13 kg/mm²) |
|---|---|---|
| Steels of this invention | A | 346 |
| | B | 552 |
| | C | 1,806 |
| | D | 1,050 |
| | E | 1,520 |
| | F | 1,020 |
| | G | 1,015 |
| | H | 547 |
| | I | 3,832 |
| | J | 1,056 |
| | K | 1,805 |
| Compared material | 9 Cr - 1 Mo steel | 30 |

TABLE 2-continued

| | Test specimen | Creep rupture time (hr) (600° C. stress 13 kg/mm²) |
|---|---|---|
| material | steel | |

Table 3

| | Test specimen | Vickers hardness (lead 10 kg) Base metal | Vickers hardness (lead 10 kg) Welding heat-affected zone (max.) | Impact fracture transition temperature (°C.) |
|---|---|---|---|---|
| Steels of this invention | A | 163 | 225 | 20 |
| | B | 178 | 240 | 18 |
| | C | 208 | 272 | −24 |
| | D | 103 | 281 | −10 |
| | E | 202 | 237 | 13 |
| | F | 196 | 264 | −10 |
| | G | 205 | 290 | 0 |
| | H | 180 | 233 | 20 |
| | I | 185 | 266 | 20 |
| | J | 193 | 273 | 0 |
| | K | 196 | 249 | 20 |
| Compared material | 9 Cr - 1 Mo steel | 168 | 383 | 25 |
| | Steel of single ferrite phase | | | 150 |

What is claimed is:

1. A high chromium steel for use at high temperatures consisting essentially of:

0.02–0.09% carbon,
less than 1.0% silicon,
0.1–2.0% manganese,
7.0–13.0% chromium,
1.2–3.0% molybdenum, said steel further consisting essentially of a mixed structure of ferrite and bainite, the ferrite phase being present in an amount from about 20 to 60% with the balance being iron and the usual impurities.

2. A high chromium steel for use at high temperatures consisting essentially of the following elements:

0.02–0.09% carbon,
less than 1.0% silicon,
0.1–2.0% manganese,
7.0–13.0% chromium,
1.2–3.0% molybdenum,
less than 0.1% aluminum, said steel consisting essentially of a mixed structure of ferrite and bainite, the ferrite phase being present in an amount from about 20 to 60% with the balance being iron and the usual impurities.

* * * * *